US008939732B2

(12) United States Patent
Kim et al.

(10) Patent No.: US 8,939,732 B2
(45) Date of Patent: Jan. 27, 2015

(54) MULTI-STAGE COMPRESSOR

(75) Inventors: Won-joong Kim, Changwon (KR); Jong-sub Shin, Changwon (KR)

(73) Assignee: Samsung Techwin Co., Ltd., Changwon (KR)

( * ) Notice: Subject to any disclaimer, the term of this patent is extended or adjusted under 35 U.S.C. 154(b) by 217 days.

(21) Appl. No.: 13/280,789

(22) Filed: Oct. 25, 2011

(65) Prior Publication Data

US 2012/0100015 A1 Apr. 26, 2012

(30) Foreign Application Priority Data

Oct. 25, 2010 (KR) ..... 10-2010-0104189

(51) Int. Cl.

| | |
|---|---|
| ***F04D 1/06*** | (2006.01) |
| ***F04D 17/12*** | (2006.01) |
| ***F04D 25/16*** | (2006.01) |
| ***F04D 29/58*** | (2006.01) |

(52) U.S. Cl.

CPC ..... *F04D 17/12* (2013.01); *F04D 25/163* (2013.01); *F04D 29/5826* (2013.01)

USPC ..... 417/244; 417/243; 417/246; 417/248

(58) Field of Classification Search

CPC ... F04D 17/12; F04D 29/5826; F04D 25/163; F04D 29/5833; F04D 27/0269

USPC ..... 417/243–253

See application file for complete search history.

(56) References Cited

U.S. PATENT DOCUMENTS

| | | | | | |
|---|---|---|---|---|---|
| 3,696,637 | A | * | 10/1972 | Ness et al. | 62/402 |
| 5,485,719 | A | * | 1/1996 | Wulf | 60/785 |
| 5,611,663 | A | * | 3/1997 | Kotzur | 415/122.1 |
| 5,901,579 | A | * | 5/1999 | Mahoney et al. | 62/646 |
| 2007/0134111 | A1 | * | 6/2007 | Eybergen et al. | 417/423.6 |

FOREIGN PATENT DOCUMENTS

| | | | | | |
|---|---|---|---|---|---|
| JP | 9-119378 | A | | 5/1997 | |
| JP | 11-294945 | A | | 10/1999 | |
| JP | 2000-104698 | A | | 4/2000 | |
| JP | 2000104698 | A | * | 4/2000 | F04D 27/00 |
| JP | 2007-332826 | A | | 12/2007 | |
| JP | 2011190796 | A | * | 9/2011 | |
| KR | 10-0861000 | B1 | | 9/2008 | |
| KR | 10-2010-0020360 | A | | 2/2010 | |

OTHER PUBLICATIONS

Communication dated Sep. 6, 2012, issued by the Korean Patent Office in counterpart Korean Application No. 10-2010-0104189.

* cited by examiner

*Primary Examiner* — Peter J Bertheaud
*Assistant Examiner* — Dominick L Plakkoottam
(74) *Attorney, Agent, or Firm* — Sughrue Mion, PLLC

(57) ABSTRACT

Provided is a multi-stage compressor which includes: a first-stage compressing unit which includes a first compressing element with an impeller and a second compressing element with an impeller, the first and second compressing elements being connected to each other; and a rear-stage compressing unit which includes at least one rear compressing element with an impeller, wherein the rear-stage compressing unit receives a fluid compressed and output from the first-stage compressing unit.

20 Claims, 3 Drawing Sheets

MULTI-STAGE COMPRESSOR

CROSS-REFERENCE TO RELATED PATENT APPLICATION

This application claims priority from Korean Patent Application No. 10-2010-0104189, filed on Oct. 25, 2010, in the Korean Intellectual Property Office, the disclosure of which is incorporated herein in its entirety by reference.

BACKGROUND

1. Field

Apparatuses consistent with exemplary embodiments relate to a compressor designed to increase an amount of incoming fluid.

2. Description of the Related Art

In general, a compression device such as a centrifugal compressor uses a rotating impeller to compress fluid by applying a centrifugal force to the fluid.

An industrial compression device includes a multi-stage compressor, an intercooler, and an electric motor. A first-stage compressor increases pressure and temperature of fluid such as air absorbed through a filter disposed at an inlet so that the fluid flows out. As the fluid passes through the intercooler, the temperature of the fluid is reduced to a room temperature. The cooled air is sucked into a second-stage compressor that increases the temperature and pressure of the fluid. After cooling down, the fluid is then delivered to a next stage compressor. Thus, a volumetric flow rate in the first-stage compressor has a maximum value and becomes an important factor in determining an overall size of the compression device.

SUMMARY

Exemplary embodiments provide a compressor including a first stage compressing unit with a plurality of compressing elements rotating in different directions, which is constructed to easily increase a flow rate.

According to an aspect of an exemplary embodiment, there is provided a multi-stage compressor including: a first-stage compressing unit which includes a first compressing element with an impeller and a second compressing element with an impeller, the first and second compressing elements being connected to each other; and a rear-stage compressing unit which includes at least one rear compressing element with an impeller, wherein the rear-stage compressing unit receives a fluid compressed and output from the first-stage compressing unit.

The impellers of the first and second compressing elements may rotate together at the same revolutions per minute (rpm).

The multi-stage compressor may further include a gear which includes a bull gear and a bull gear axle, first and second pinion gears connected to two sides of the bull gear, respectively, and first and second pinion gear axles supporting the first and second pinion gears, respectively. The first compressing element may be rotatably coupled to one end of the first pinion gear axle at one side of the bull gear. The second compressing element may be coupled to the other end of the first pinion gear axle to rotate together with the first compressing element. The impeller of the at least one rear compressing element may be coupled to an end of the second pinion gear axle at the other side of the bull gear.

The at least one rear compressing element may include a second-stage compressing element having an impeller and a third-stage compressing element having an impeller introducing the fluid compressed by the second-stage compressing element.

The second-stage compressing element may be synchronized with the third-stage compressing element.

The multi-stage compressor may further include a first intercooler disposed on a pipe between the first compressing unit and the second-stage compressing element and a second intercooler disposed on a pipe between the second-stage compressing element and third-stage compressing element.

The at least one rear compressing element may rotate at a higher speed than either of the first compressing element and the second compressing element of the first-stage compressing unit.

The impellers of the first and second compressing elements may rotate at the same revolutions per minute (rpm) in opposite directions.

The first and second compressing elements may be connected to a pipe to distribute and receive the fluid from an outside, and merge together and output the compressed fluid.

BRIEF DESCRIPTION OF THE DRAWINGS

The above and other aspects of the inventive concept will become more apparent by describing in detail exemplary embodiments thereof with reference to the attached drawings, in which.

DETAILED DESCRIPTION OF EXEMPLARY EMBODIMENTS

Figure 1:
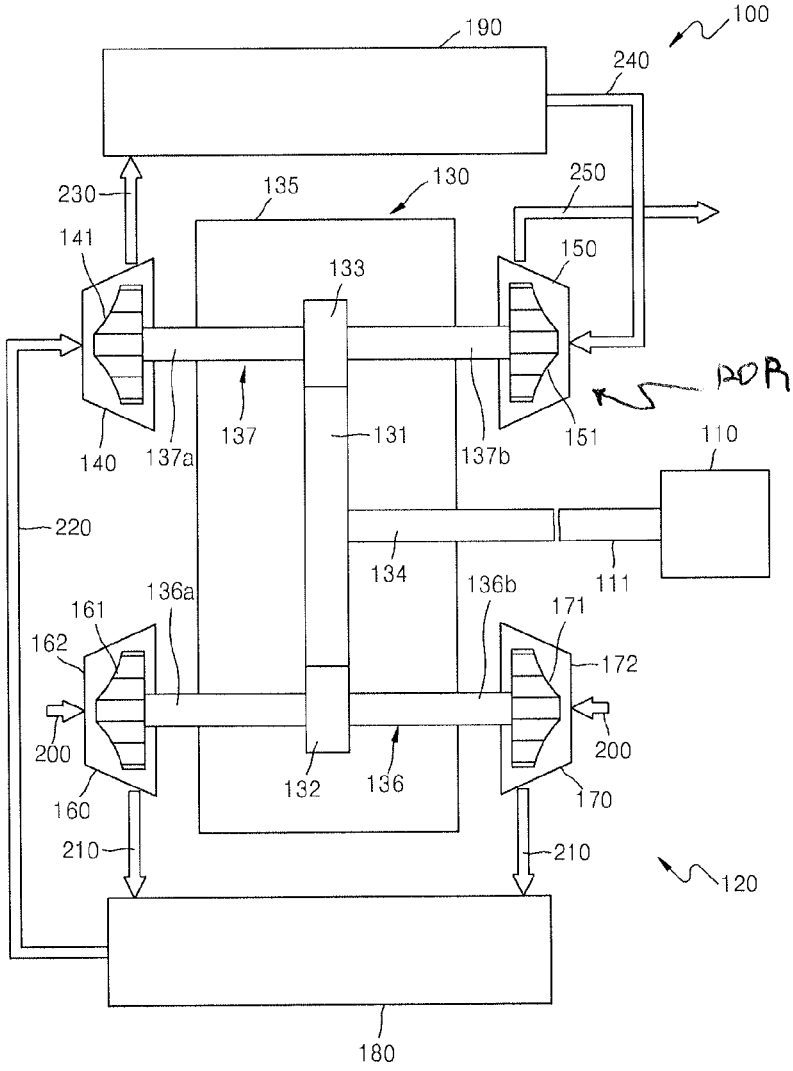
FIG. 1 illustrates construction of a multi-stage compressor according to an exemplary embodiment.

The inventive concept will now be described more fully with reference to the accompanying drawings, in which exemplary embodiments of the inventive concept are shown.

As the inventive concept allows for various changes and numerous exemplary embodiments, particular exemplary embodiments will be illustrated in the drawings and described in detail in the description. However, this is not intended to limit the inventive concept to a particular mode of practice, and it is to be appreciated that the inventive concept encompasses all changes, equivalents, and substitutes that do not depart from the spirit and technical scope thereof. In the description of exemplary embodiments, well-known methods will not be described in detail so as not to unnecessarily obscure the essence of the inventive concept.

While the terms such as "first" and "second" may be used to describe various components, such components must not be limited to the above terms. The terms are used only to distinguish one component from another.

The terms used in the present application are merely used to describe a particular exemplary embodiment, and are not intended to limit the inventive concept. Use of singular forms includes plural references as well unless expressly specified otherwise. The terms "comprising", "including", and "having" specify the presence of stated features, numbers, steps, operations, elements, components, and/or a combination thereof but do not preclude the presence or addition of one or more other features, numbers, steps, operations, elements, components, and/or a combination thereof. A compressor according to an exemplary embodiment will now be described more fully with reference to the accompanying drawings. An identical or corresponding component is assigned the same reference numeral and a detailed description thereof will be omitted. FIG. 1 illustrates construction of a multi-stage compressor 100 according to an exemplary embodiment. Referring to FIG. 1, the multi-stage compressor 100 includes an electric motor 110, a step-up gear 130, and a plurality of compressing elements 140 through 170.

The electric motor 110 includes a motor providing power to the multi-stage compressor 100. The electric motor 110 may be a variable speed electric motor that is free to change a rotation speed.

The step-up gear 130 includes a bull gear 131, a first pinion gear 132 connected to one side of the bull gear 131, and a second pinion gear 133 connected to the other side of the bull gear 131. The step-up gear 130 is a twin pinion type step-up gear in which the bull gear 131 meshes with each of the first and second pinion gears 132 and 133.

A bull gear rotation axle 134 has one end coupled to the bull gear 131 and the other end drawn out a step-up gear case 135 and coupled to an electric motor output axle 111 combined with the electric motor 110. The bull gear 131 receives a rotation force of the electric motor 110 to rotate.

The first and second pinion gears 132 are rotatably supported by first and second pinion gear axles 136 and 137, respectively. The first and second pinion gears 132 and 133 rotate at different revolutions per minute (rpm).

A first-stage compressing unit 120 is connected to the first pinion gear axle 136.

In this case, the first-stage compressing unit 120 includes first and second compressing elements 160 and 170. That is, a first impeller 161 of the first compressing element 160 is connected to one end 136*a* of the first pinion gear axle 136 while a second impeller 171 of the second compressing element 170 is connected to the other end 136*b* of the first pinion gear axle 136.

The first and second impellers 161 and 171 receive a rotation force of the first pinion gear axle 136 so that they can rotate together. In this case, the first and second impellers 161 and 171 have the same fluid dynamic design so that they rotate at the same rpm but in opposite directions.

First and second suction ports 162 and 172 are disposed at inlets of the first and second compressing elements 160 and 170, respectively, to simultaneously introduce a fluid 200 such as air. In this case, the fluid 200 drawn in through the first and second suction ports 162 and 172 are introduced into the first and second compressing elements 160 and 170 at the same flow rate.

As described above, the first-stage compressing unit 120 includes the first and second compressing elements 160 and 170 that have the same fluid dynamic design so that they can rotate at the same rpm but in opposite directions and compress the fluid 200 introduced through the first and second suction ports 162 and 172. Thus, the first-stage compressing unit 120 achieves a flow rate that is increased by double compared to a compressing unit including a single compressing element. While the first-stage compressing unit 120 includes the first and second compressing elements 160 and 170, the number of compressing elements is not limited thereto.

A first intercooler 180 is disposed at an exit of the first-stage compressing unit 120. The fluid 200 compressed by the first-stage compressing unit 120 can be supplied to the first intercooler 180 via a first pipe 210. The first intercooler 180 may be additionally installed to lower the temperature of the fluid 200 increased due to compression by the first-stage compressing unit 120, thereby achieving a desired compression ratio with low power in the multi-stage compressor 100.

Second- and third-stage compressing elements 140 and 150 of a rear-stage compressing unit 120R are coupled to the second pinion gear axle 137. That is, the second pinion gear axle 137 has one end 137a connected to an impeller 141 in the second-stage compressing element 140 and the other end 137*b* connected to an impeller 151 in the third-stage compressing element 150.

In this case, the second-stage compressing element 140 is synchronized with the third-stage compressing element 150. The second- and third-stage compressing elements 140 and 150 rotate at a higher speed than the first-stage compressing unit 120.

While two compression stages such as the second- and third-stage compressing elements 140 and 150 are disposed to the rear of the first-stage compressing unit 120, the number of compression stages is not limited thereto if at least one compression stage is applied.

A second pipe 220 is disposed between the first intercooler 180 and the second-stage compressing element 140 to supply the compressed fluid 200 output from the first intercooler 180 to the second-stage compressing element 140. A second intercooler 190 is disposed at an exit of the second-stage compressing element 140. The fluid 200 compressed by the second-stage compressing element 140 can be supplied to the second intercooler 190 via a third pipe 230. A fourth pipe 240 is disposed between the second intercooler 190 and the third-stage compressing element 150 to supply the fluid 200 output from the second intercooler 190 to the third-stage compressing element 150.

The operation of the multi-stage compressor 100 having the above-mentioned construction according to the present exemplary embodiment will now be described with reference to FIG. 1.

Upon application of power, the electric motor 110 rotates. When the electric motor 110 rotates, an electric motor output axle 111 coupled to the electric motor 110, the bull gear rotation axle 134 coupled to the electric motor output axle 111, and the bull gear 131 coupled to the bull gear rotation axle 134 rotate together. The bull gear 131 rotates at the same rpm as the electric motor 110.

Subsequently, each of the first pinion gear 132 coupled to one side of the bull gear 131 and the second pinion gear 133 coupled to the other side thereof rotates at a predetermined rpm.

This causes the first impeller 161 of the first compressing element 160 connected to the one end 136*a* of the first pinion gear axle 136 and the second impeller 171 of the second compressing element 170 coupled to the other end 136*b* of the first pinion gear axle 136 to rotate together.

At the same time, the impeller 141 of the second-stage compressing element 140 coupled to the one end 137*a* of the second pinion gear axle 137 and the impeller 151 of the third-stage compressing element 150 coupled to the other end 137*b* thereof rotate together.

The principle of compression using the first-stage compressing unit 120 and the second- and third-stage compressing elements 140 and 150 is realized by converting a kinetic energy generated by high-speed rotation of the impellers 141, 151, 161, and 171 to pressure energy. Since a compression ratio that can be achieved by a single-stage compressor is limited, the multi-stage compressor 100 employs multi-stage compression.

The fluid 200 received through a filter (not shown) disposed at an inlet of the multi-stage compressor 100 is provided to the first and second compressing elements 160 and 170 of the first-stage compressing unit 120 through the first and second suction ports 162 and 172. In this case, the first and second impellers 161 and 171 rotate at the same rpm but in opposite directions. When the fluid 200 is introduced simultaneously into the first and second impellers 161 and 171, a flow rate of the incoming fluid 200 is substantially equally distributed to the first and second impellers 161 and 171.

The fluid 200 compressed by the first-stage compressing unit 120 is delivered to the first intercooler 180 via the first pipe 210. In this case, a volume of the fluid 200 delivered to the first intercooler 180 is equal to a sum of volumes of the fluid 200 delivered from the first and second compressing elements 160 and 170, respectively. The fluid 200 delivered to the first intercooler 180 is cooled down by cooling water or other media to lower temperature of the fluid 200.

The cooled fluid 200 is then delivered to the second-stage compressing element 140 via the second pipe 220 and is further compressed due to rotation of the impeller 141, thus resulting in increase of the temperature of the fluid 200. The high-temperature fluid 200 is discharged through the third pipe 230 and is delivered to the second intercooler 190 for further cooling.

The further cooled fluid 200 is then delivered to the third-stage compressing element 150 via the fourth pipe 240, is further compressed due to rotation of the impeller 151, and ejected through a fifth pipe 250.

The multi-stage compressor 100 according to the present exemplary embodiment achieves a flow rate that is increased by double by using the first-stage compressing unit 120 including the first and second compressing elements 160 and 170 having the same fluid dynamic design and with the impellers 161 and 171 rotating in opposite directions. Furthermore, the fluid 200 fed from the two compressing elements 160 and 170 in the first-stage compressing unit 120 merge together and flows into other compressing elements 140 and 150.

Figure 2:
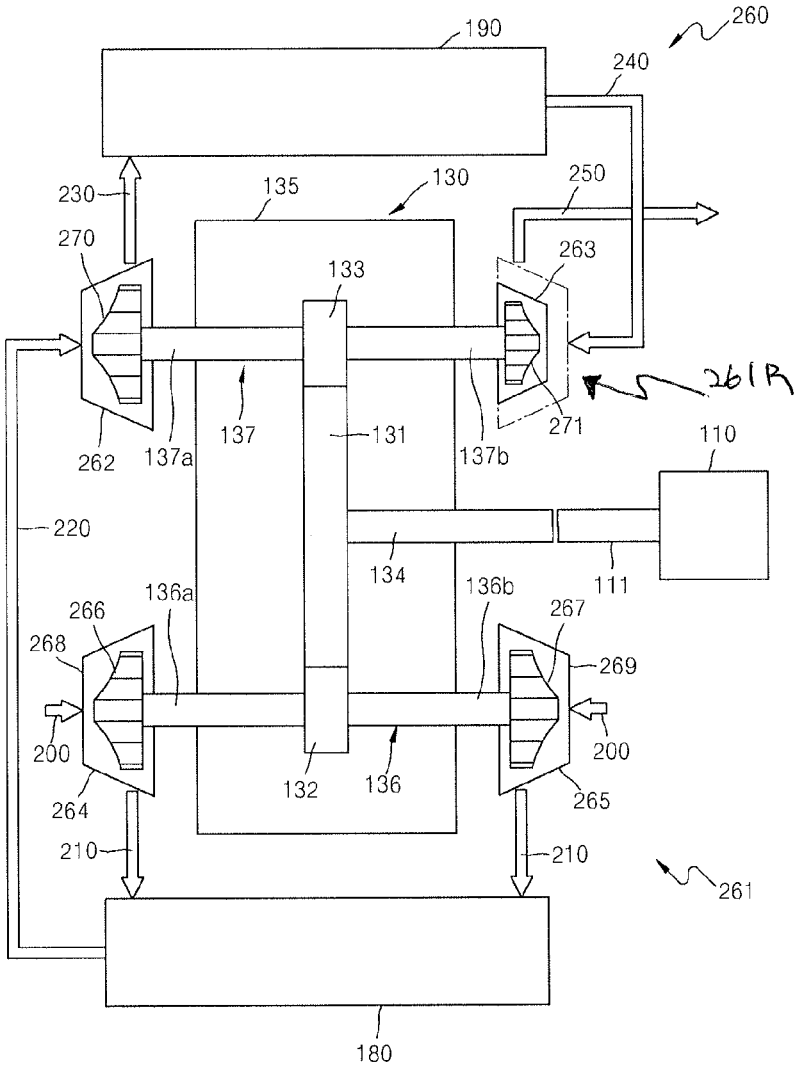
FIG. 2 illustrates construction of a multi-stage compressor according to another exemplary embodiment.

FIG. 2 illustrates construction of a multi-stage compressor 260 according to another exemplary embodiment. Hereinafter, the construction and functions of elements featured in the present exemplary embodiment are described with reference to FIG. 2.

Referring to FIG. 2, the multi-stage compressor 260 according to the present exemplary embodiment includes an electric motor 110, a step-up gear 130, and a plurality of compressing elements 261 through 263.

The plurality of compressing elements 261 through 263 include a first-stage compressing unit 261, and second- and third-stage compressing elements 262 and 263 of a rear-stage compressing unit 261R. The first-stage compressing unit 261 includes first and second compressing elements 264 and 265 connected to both ends 136*a* and 136*b* of the first pinion gear axle 136, respectively. More specifically, a first impeller 266 of the first compressing element 264 is connected to one end 136*a* of the first pinion gear axle 136 while a second impeller 267 of the second compressing element 265 is connected to the other end 136*b* of the first pinion gear axle 136.

The first and second impellers 266 and 267 receive a rotation force of the first pinion gear axle 136 so that they can rotate together. In this case, the first and second impellers 266 and 267 rotate at the same rpm but in opposite directions. First and second suction ports 268 and 269 are disposed at inlets of the first and second compressing elements 264 and 265, respectively. Thus, a fluid 200 drawn in through the first and second suction ports 268 and 269 are introduced into the first and second compressing elements 264 and 265 at the same flow rate.

The second- and third-stage compressing elements 262 and 263 are coupled to a second pinion gear axle 137. The second pinion gear axle 137 has one end 137*a* connected to an impeller 270 in the second-stage compressing element 262 and the other end 137*b* connected to an impeller 271 in the third-stage compressing element 263.

Unlike in the exemplary embodiment described with reference to FIG. 1, the first-stage compressing unit 261 and the second-stage compressing element 262 employ first and second impellers 266 and 267 of the same size in order to achieve commonality among components of the first-stage compressing unit 261 and the second-stage compressing element 262.

However, the third-stage compressing element 263 is smaller than the second-stage compressing element 262, as indicated by a dotted line in FIG. 2. In this case, the third-stage compressing element 263 may have a predetermined size less than that of first and second compressing elements 264 and 265 in the first-stage compressing unit 261 and second-stage compressing element 262, depending on to a flow rate ratio of the fluid 200 being introduced thereto.

The second-stage compressing element 262 is synchronized with the third-stage compressing element 263. Thus, the second- and third-stage compressing elements 262 and 263 rotate at the same speed. However, the second- and third-stage compressing elements 262 and 263 rotate at higher speed than the first-stage compressing unit 261.

As described above, one (262 in FIG. 2) of the second- and third-stage compressing elements 262 and 263 disposed at the rear of the first-stage compressing unit 261 may have the same impeller size as the first-stage compressing unit 261 in order to achieve commonality of components. The other compressing element (263 in FIG. 2) may have a smaller impeller size according to a flow rate ratio of the fluid 200.

Figure 3:
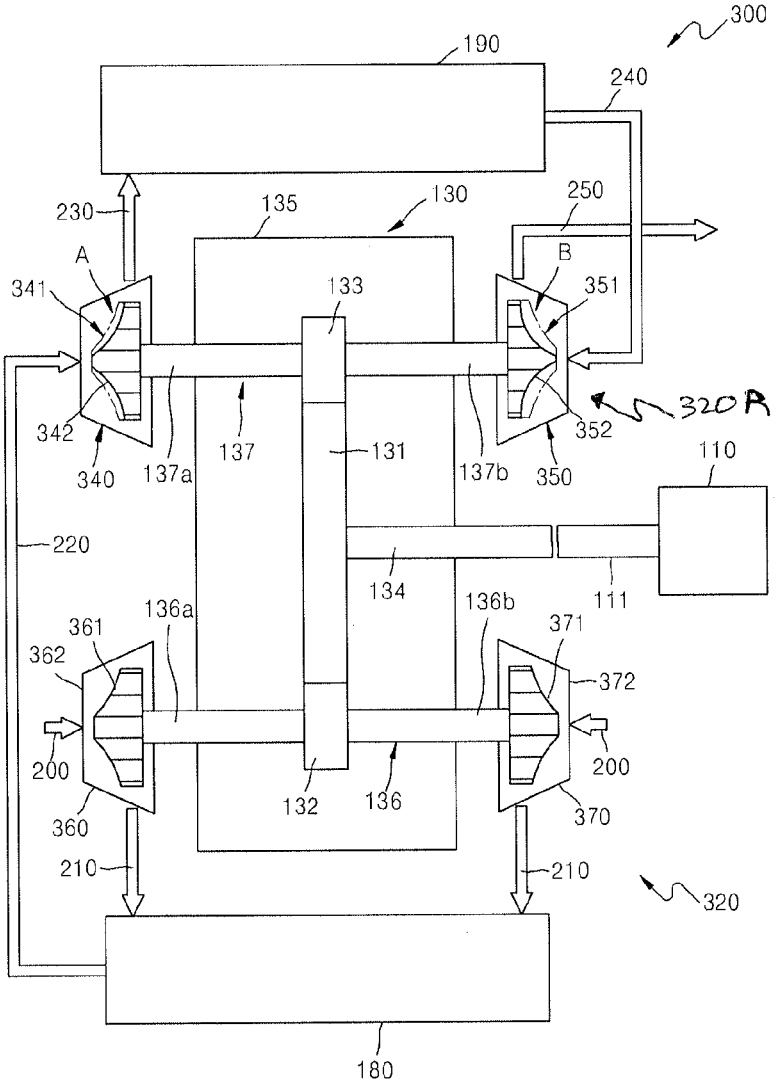
FIG. 3 illustrates construction of a multi-stage compressor according to still another exemplary embodiment.

FIG. 3 illustrates construction of a multi-stage compressor 300 according to still another exemplary embodiment.

Referring to FIG. 3, the multi-stage compressor 300 according to the present exemplary embodiment includes an electric motor 110, a step-up gear 130, and a plurality of compressing units 320 and 320R.

The plurality of compressing units 320 and 320R include a first-stage compressing unit 320, and a rear-stage compressing unit 320R including second- and third-stage compressing elements 340 and 350.

The first-stage compressing unit 320 includes first and second compressing elements 360 and 370 connected to two ends 136*a* and 136*b* of the first pinion gear axle 136, respectively. More specifically, a first impeller 361 of the first compressing element 360 is connected to one end 136*a* of the first pinion gear axle 136 while a second impeller 371 of the second compressing element 370 is connected to the other end 136*b* of the first pinion gear axle 136. The first and second impellers 266 and 267 rotate at the same rpm but in opposite directions.

The second- and third-stage compressing elements 340 and 350 are coupled to a second pinion gear axle 137. The second pinion gear axle 137 has one end 137*a* connected to an impeller 341 in the second-stage compressing element 340 and the other end 137*b* connected to an impeller 351 in the third-stage compressing element 350.

Unlike in the exemplary embodiments described with reference to FIGS. 1 and 2, the second- and third-stage compressing elements 340 and 350 employ the impellers 341 and 351 with blades 342 and 352 having top portions cut as indicated by dotted lines in FIG. 3.

More specifically, the first-stage compressing unit 320 and the second and third compressing elements 340 and 350 employ master impellers having the same size in order to achieve commonality among components of the first-stage compressing unit 320 and the second- and third-stage compressing elements 340 and 350.

When master impellers are used as the impellers 342 and 352, the impellers 342 and 352 in the second- and third-stage compressing elements 340 and 350 are manufactured by cutting top portions of the blades 342 and 352. In this case, a part B formed by cutting the top portion of the blade 352 in the third-stage compressing element 350 is steeper than a part A formed by cutting the top portion of the blade 342 in the second-stage compressing element 340.

In other words, depending on a flow rate of the fluid 200 being introduced, the third-stage compressing element 350 may be made smaller than the second-stage compressing element 340. To achieve this, the part B formed by cutting the top portion of the blade 352 is wider than the part A formed by cutting the top portion of the blade 342.

As described above, the first-stage compressing unit 320 and the second- and third-stage compressing elements 340 and 350 are formed using the master impellers of the same size. Furthermore, portions of the blades 342 and 352 in the second- and third-stage compressing elements 340 and 350 disposed at the rear of the first-stage compressing unit 320 are cut away according to a flow rate ratio. Thus, commonality can be achieved among components of the first-stage compressing unit 320 and the second- and third-stage compressing elements 340 and 350.

As described above, the multi-stage compressor 100 includes a plurality of compressing elements at the same compression stage, thereby providing a flow rate that is increased by double.

What is claimed is:

1. A multi-stage compressor comprising: a first-stage compressing unit comprising a first compressing element comprising an impeller to receive and compress a first portion of a fluid and a second compressing element comprising an impeller to receive and compress a second portion of the fluid; and a rear-stage compressing unit comprising at least one rear compressing element comprising an impeller; and a first intercooler disposed between the first-stage compressing unit and the rear-stage compressing unit in a flow direction of the fluid and configured to separately receive the first portion of the fluid from the first compressing element and the second portion of the fluid from the second compressing element and also merge the first and second portions of the fluid into a merged fluid, wherein the rear-stage compressing unit is configured to receive and compress the merged fluid compressed and output from the first-stage compressing unit, and wherein the first-stage compressing unit is configured such that each of the first and second portions of the fluid compressed by the first and second compressing elements, respectively, is not subsequently compressed by the other of the first and second compressing elements before the rear-stage compressing unit receives the merged fluid.

2. The multi-stage compressor of claim 1, wherein the impellers of the first and second compressing elements rotate together at the same revolutions per minute (rpm).

3. The multi-stage compressor of claim 2, further comprising a gear comprising a bull gear and a bull gear axle, first and second pinion gears connected to two sides of the bull gear, respectively, and first and second pinion gear axles supporting the first and second pinion gears, respectively, wherein the first compressing element is rotatably coupled to one end of the first pinion gear axle at one side of the bull gear, wherein the second compressing element is coupled to the other end of the first pinion gear axle to rotate together with the first compressing element, and wherein the impeller of the at least one rear compressing element is coupled to an end of the second pinion gear axle at the other side of the bull gear.

4. The multi-stage compressor of claim 2, wherein the at least one rear compressing element comprises a second-stage compressing element comprising an impeller and a third-stage compressing element comprising an impeller configured to receive the merged fluid compressed by the second-stage compressing element.

5. The multi-stage compressor of claim 4, wherein the second-stage compressing element is synchronized with the third-stage compressing element.

6. The multi-stage compressor of claim 4, further comprising:

a second intercooler disposed between the second-stage compressing element and the third-stage compressing element.

7. The multi-stage compressor of claim 2, wherein the rear-stage compressing unit rotates at a higher speed than the first compressing element and the second compressing element of the first-stage compressing unit.

8. The multi-stage compressor of claim 2, wherein the impellers of the first and second compressing elements rotate together at the same rpm in opposite directions when viewed from a front of each of the impellers to which each of the first and second portions of the fluid is introduced, respectively, and wherein the first and second compressing elements are connected to each other via a common axle.

9. The multi-stage compressor of claim 1, wherein the first and second compressing elements are each connected to a different pipe to separately distribute the compressed first and second portions of the fluid, respectively.

10. The multi-stage compressor of claim 3, wherein each of the first and second compressing elements has the same size as each of the at least one rear compressing element.

11. The multi-stage compressor of claim 10, wherein the at least one rear compressing element comprises second- and third-stage compressing elements coupled to both ends of the second pinion gear axle, respectively, wherein each of the first and second compressing elements of the first-stage compressing unit has the same size as the second-stage compressing element, and wherein the third-stage compressing element is disposed at a rear of the second-stage compressing element and is smaller than the second-stage compressing element.

12. The multi-stage compressor of claim 2, wherein each of the first and second compressing elements of the first-stage compressing unit has the same size as each of the at least one rear compressing element.

13. The multi-stage compressor of claim 2, wherein a size of the impeller of each of the first and second compressing elements is different from a size of the impeller of the compressing element of the at least one rear compressing element.

14. The multi-stage compressor of claim 2, wherein the at least one rear compressing element comprise second- and third-stage compressing elements, connected to each other, each of which comprises an impeller, wherein the third-stage compressing element is configured to receive the merged fluid compressed and output from the second-stage compressing element, and wherein a size of the impeller of the third-stage compressing element is smaller than a size of the impeller of the second-stage compressing element which is the same as the size of the impeller of each of the first and second compressing elements.

15. The multi-stage compressor of claim 2, wherein the at least one rear compressing element comprise second- and third-stage compressing elements, connected to each other, each of which comprises an impeller each comprising a plurality of blades, wherein the third-stage compressing element is configured to receive the merged fluid compressed at the second-stage compressing element, and wherein the impeller of each of the second- and third-stage compressing elements is the same as the impeller of each of the first and second compressing elements except that the blades of the impeller included in each of the second- and third-stage compressing elements are cut more at a top portion than a top portion of the blades of the impeller of each of the first and second compressing elements.

16. The multi-stage compressor of claim 15, wherein the top portion of the blades of the impeller of the third-stage compressing element is cut more than the top portion of the blades of the impeller of the second-stage compressing element.

17. A multi-stage compressor comprising: a front-stage compressing unit comprising at least two compressing elements which are configured to receive and compress first and second portions of a fluid and generate pressure using the compressed first and second portions of the fluid, respectively, at a same time;

at least one cooler configured to separately receive the compressed first and second portions of the fluid output from the at least two compressing elements and lower down temperature of the first and second portions of the fluid and also merge the first and second portions of the fluid into a merged fluid; and a rear-stage compressing unit comprising at least one compressing element which receives the temperature-lowered merged fluid to generate pressure, the at least one cooler provided between the front-stage compressing unit and the rear-stage compressing unit in a flow direction of the fluid, wherein the front-stage compressing unit is configured such that each of the first and second portions of the fluid compressed by the first and second compressing elements, respectively, is not subsequently compressed by the other of the first and second compressing elements before the rear-stage compressing unit receives the temperature-lowered merged fluid.

18. The multi-stage compressor of claim 17, wherein the at least two compressing elements of the front-stage compressing unit comprise respective impellers which rotate at the same speed in different directions when viewed from a front of each of the impellers to which each of the first and second portions of the fluid is introduced, respectively, and wherein the at least two comprising elements are connected to one another and, each of the at least two compressing elements is configured to receive a substantially same amount of a fluid at a substantially same flow rate to generate the pressure.

19. The multi-stage compressor of claim 18, wherein the at least one compressing element of the rear-stage compressing unit comprises a plurality of compressing elements each of which comprises an impeller, and each impeller is synchronized with another and rotates faster than either one of the impellers of the at least two compressing elements of the front-stage compressing unit, and wherein a size of an impeller of a compressing element to receive the temperature-lowed merged fluid lastly among the at least one compressing element of the rear-stage compressing unit is the smallest compared to the other impellers of the at least one compressing element.

20. The multi-stage compressor of claim 1, wherein the first and second compressing elements are configured to receive, compress and output the first and second portions of the fluid substantially at the same time.

* * * * *